US010364954B2

(12) United States Patent
Deering

(10) Patent No.: US 10,364,954 B2
(45) Date of Patent: Jul. 30, 2019

(54) LENS HEATING SYSTEMS AND METHODS FOR AN LED LIGHTING SYSTEM

(71) Applicant: J.W. SPEAKER CORPORATION, Germantown, WI (US)

(72) Inventor: Eric Deering, Hartland, WI (US)

(73) Assignee: J.W. SPEAKER CORPORATION, Germantown, WI (US)

( * ) Notice: Subject to any disclaimer, the term of this patent is extended or adjusted under 35 U.S.C. 154(b) by 0 days.

(21) Appl. No.: 15/182,994

(22) Filed: Jun. 15, 2016

(65) Prior Publication Data

US 2016/0363286 A1 Dec. 15, 2016

Related U.S. Application Data

(60) Provisional application No. 62/175,542, filed on Jun. 15, 2015.

(51) Int. Cl.
*F21S 41/141* (2018.01)

(52) U.S. Cl.
CPC ..... *F21S 41/141* (2018.01)

(58) Field of Classification Search
CPC ..... F21S 48/115
See application file for complete search history.

(56) References Cited

U.S. PATENT DOCUMENTS 4,109,133 A † 8/1978 Hanle et al.
4,488,033 A † 12/1984 Trachtenberg
4,543,466 A † 9/1985 Ramus
5,090,122 A 2/1992 Kitagawa
5,417,745 A † 5/1995 Oprosky
6,465,951 B1 10/2002 Krafcik et al.
6,641,860 B1 11/2003 Kaiserman et al.
7,129,444 B2 † 10/2006 Weiss
7,347,382 B2 3/2008 Ferber et al.
7,489,053 B2 2/2009 Gentile et al.
7,594,442 B2 9/2009 Kaiserman et al.
8,008,606 B2 8/2011 Kaiserman et al.
8,169,684 B2 * 5/2012 Bugno ..... B60R 1/088 359/265
8,441,156 B2 5/2013 Boss et al.
8,680,440 B2 3/2014 Cohen et al.
8,998,458 B2 4/2015 Tankala et al.
2003/0002179 A1 * 1/2003 Roberts ..... B60Q 1/2665 359/838
2005/0194454 A1 9/2005 Ferber et al.
2006/0060576 A1 * 3/2006 Haas ..... A41D 13/0051 219/543
2006/0109074 A1 5/2006 Lee et al.
(Continued)

FOREIGN PATENT DOCUMENTS

WO 2000055685 A 9/2000
WO 2007022027 A2 2/2007

OTHER PUBLICATIONS

PCT/US16/37538; Search Report and Written Opinion; dated Sep. 8, 2016; 18 pages.

*Primary Examiner* — Evan P Dzierzynski
(74) *Attorney, Agent, or Firm* — Quarles & Brady LLP

(57) ABSTRACT

Systems and methods for lighting system lens heating are described. The systems and methods include a substantially clear thermoplastic substrate; and a conductive ink or film circuit on the thermoplastic substrate.

19 Claims, 13 Drawing Sheets

(56) References Cited

U.S. PATENT DOCUMENTS

| | | | | |
|---|---|---|---|---|
| 2008/0180779 | A1* | 7/2008 | McCabe | G02F 1/157 359/267 |
| 2010/0072416 | A1 | 3/2010 | Fujioka et al. | |
| 2012/0228240 | A1 | 9/2012 | Gentile et al. | |
| 2013/0114279 | A1 | 5/2013 | Marley | |
| 2013/0249375 | A1† | 9/2013 | Panagotacos | |
| 2013/0323548 | A1* | 12/2013 | Iwamoto | H01M 2/348 429/62 |
| 2014/0036428 | A1 | 2/2014 | Leong et al. | |
| 2014/0111469 | A1 | 4/2014 | Foerster et al. | |
| 2014/0262722 | A1 | 9/2014 | Haag et al. | |
| 2015/0023023 | A1 | 1/2015 | Livesay et al. | |
| 2015/0048161 | A1 | 2/2015 | Gentile et al. | |
| 2015/0054417 | A1 | 2/2015 | Lee | |
| 2015/0055363 | A1* | 2/2015 | Van Straten | F21S 8/085 362/520 |
| 2016/0046262 | A1 | 2/2016 | Van Straten | |
| 2016/0215952 | A1* | 7/2016 | Dunn | F21S 48/34 |

* cited by examiner
† cited by third party

| INK TYPE | 1. 47955 | | | 2. SUN 3818–136B | | | 3. SUN AST 6010 | | |
|---|---|---|---|---|---|---|---|---|---|
| MATERIAL TYPE | PC–0100 | PC–0250 | PC–0280 | PC–0100 | PC–0250 | PC–0280 | PC–0100 | PC–0250 | PC–0280 |
| 1 | 22.1 | 23.3 | 23.4 | 24.1 | 28.6 | 28.9 | 9.7 | 9.8 | 10.5 |
| 2 | 21.7 | 29 | 22.7 | 36.8 | 43 | 41.6 | 10.1 | 10 | 10.9 |
| 3 | 22.4 | 23.1 | 23.3 | 36.6 | 29 | 28.2 | 9.6 | 9.7 | 9.4 |
| 4 | 22.3 | 22.6 | 23.4 | 25.8 | 47.6 | 40.2 | 9.8 | 10.1 | 9.6 |
| 5 | 22.7 | 22.7 | 23.3 | 25.4 | 28.3 | 29.1 | 9.8 | 9.8 | 10 |
| 6 | 22.5 | 22.3 | 22.7 | 33.8 | 50 | 40.8 | 9.2 | 9.5 | 10.4 |
| 7 | 22.5 | 23.4 | 22.4 | 25.3 | | 39.4 | 9.6 | | |
| 8 | 22.2 | 23.4 | | 33.8 | | 28.7 | 10 | | |
| 9 | | | | | | 28.1 | | | |
| 10 | | | | | | 41.1 | | | |

RESISTANCE MEASURED IN OHMS

= DIELECTRIC APPLIED TO CIRCUIT

FIG. 6

| | WITH CONDUCTIVE TRACE HEATER | WITHOUT CONDUCTIVE TRACE HEATER | % DECREASE |
|---|---|---|---|
| HIGH BEAM LUMENS | 775 LUMENS | 897 LUMENS | 13.6% |
| LOW BEAM LUMENS | 546 LUMENS | 634 LUMENS | 13.9% |
| HIGH BEAM MAXIMUM INTENSITY | 34156 CANDELA | 38974 CANDELA | 12.4% |
| LOW BEAM MAXIMUM INTENSITY | 18180 CANDELA | 20179 CANDELA | 9.9% |

FIG. 20

LENS HEATING SYSTEMS AND METHODS FOR AN LED LIGHTING SYSTEM

CROSS-REFERENCE TO RELATED APPLICATIONS

This application claims priority to and the benefit of U.S. Provisional Patent Application Ser. No. 62/175,542, filed Jun. 15, 2015, and entitled "Headlamp Lens Heating Systems and Methods," which is hereby incorporated by reference.

STATEMENT OF FEDERALLY SPONSORED RESEARCH OR DEVELOPMENT

Not applicable.

FIELD OF THE TECHNOLOGY

The present technology relates to an LED lighting system. More particularly, the technology relates to systems and methods for providing an LED lighting system lens heater.

BACKGROUND

Most vehicles include some form of a vehicle headlamp and tail lamp, and other lighting systems. Lighting systems that use incandescent or HID bulbs, for example, generate sufficient radiation, particularly in the non-visible spectrum, so that in colder conditions, moisture in the form of condensation, rain, sleet, or snow does not form ice on the lighting system, which would reduce optical transmission of the lighting system lens. Some lights that use LEDs for illumination do not generate sufficient radiation to melt snow and ice from the lighting system lens.

Therefore, what is needed are improved systems and methods that sufficiently heat a lighting system lens to melt snow and ice to avoid reducing optical transmission of the lighting system lens.

BRIEF SUMMARY OF THE TECHNOLOGY

The present technology provides lighting system lens heating systems and methods.

In one form, the technology provides a system for heating a lens of a LED lighting system.

In another form, the technology provides a method of heating a LED lighting system.

In accordance with one embodiment of the technology, a system for heating the lens of a lighting system is disclosed. The system comprises a substantially clear thermoplastic substrate; and a conductive ink or film circuit on the thermoplastic substrate.

In some embodiments, the heating system further includes a lens heater circuit, with a lens heater controller operatively coupled to the lens heater circuit.

In some embodiments, the conductive ink circuit is screen printed on the thermoplastic substrate.

In some embodiments, the conductive ink circuit is a conductive silver trace.

In some embodiments, the conductive film circuit is a conductive silver trace.

In some embodiments, a heating output of the conductive ink circuit is regulated based upon the temperature of the conductive ink circuit utilizing a positive temperature coefficient (PTC) ink trace.

In some embodiments, the heating system further includes a dielectric top coating on the conductive ink circuit.

In some embodiments, the conductive ink circuit has a resistance in the range of about 5 ohms to about 300 ohms.

In some embodiments, the conductive ink circuit includes traces that are generally equal length.

In some embodiments, the traces are connected with a busbar on a non-power connect side.

In some embodiments, the traces have a width in the range of about 0.05 mm to about 1.0 mm.

In some embodiments, the conductive ink circuit produces about 1 W/in^2.

In some embodiments, the conductive ink circuit is a substantially transparent ink.

In some embodiments, the lens heater controller regulates the conductive ink circuit voltage to increase or decrease the power being dissipated by the conductive ink circuit.

In some embodiments, the heating system further includes a lighting system lens, wherein the conductive ink circuit remains exposed on the inside of the lighting system lens.

In accordance with another embodiment of the technology, an LED lighting system assembly having a heated lens is disclosed. The assembly comprises a housing, the housing including a base and a lens, the lens having a interior lens side and an exterior lens side; at least one LED positioned within the base to provide illumination through the lens; a lens heater controller; a lens heater circuit operatively coupled to the lens heater controller; a substantially clear thermoplastic substrate positioned on the interior lens side; and a conductive ink or film circuit on the thermoplastic substrate operatively coupled to the lens heater circuit.

In some embodiments, the conductive ink on the thermoplastic substrate is placed into a pocket on a core of an injection molding tool with the conductive ink side against the core, and the conductive ink side remains exposed on a final lighting system lens part.

In some embodiments, the conductive ink on the thermoplastic substrate is placed against a cavity side of an injection molding tool, with the conductive ink side encapsulated between the thermoplastic substrate and a final lighting system lens part.

In some embodiments, a thermoplastic resin then over molds the thermoplastic substrate, bonding only to the non-printed side of the thermoplastic substrate.

In some embodiments, the injection molding tool uses vacuum to recess and hold the thermoplastic substrate in the core.

In some embodiments, greater than 90 percent transmission rate in terms of both lumens and intensity is achieved.

In accordance with another embodiment of the technology, a method for heating a lens of a lighting system is disclosed. The method can include applying a conductive ink or film circuit on a substantially clear thermoplastic substrate; applying the conductive ink or film circuit on the substantially clear thermoplastic substrate to at least one of an interior lens side and an exterior lens side; and applying a controlled power to the conductive ink or film circuit to heat the lens.

In some embodiments, the method further includes applying a PTC trace near the conductive ink or film circuit; sensing the resistance of the PTC trace; and controlling the power to the conductive ink or film circuit based on the sensed resistance of the PTC trace.

These and other benefits may become clearer upon making a thorough review and study of the following detailed description. Further, while the embodiments discussed above can be listed as individual embodiments, it is to be understood that the above embodiments, including all elements contained therein, can be combined in whole or in part.

BRIEF DESCRIPTION OF THE DRAWINGS

The invention will be better understood and features, aspects and advantages other than those set forth above will become apparent when consideration is given to the following detailed description thereof. Such detailed description makes reference to the following drawings.

FIG. 6 is a table showing resistance repeatability data for various configurations;

FIG. 20 is a table showing the optical impact of the lens heater traces on low beam illumination and hi beam illumination.

Figure 1:
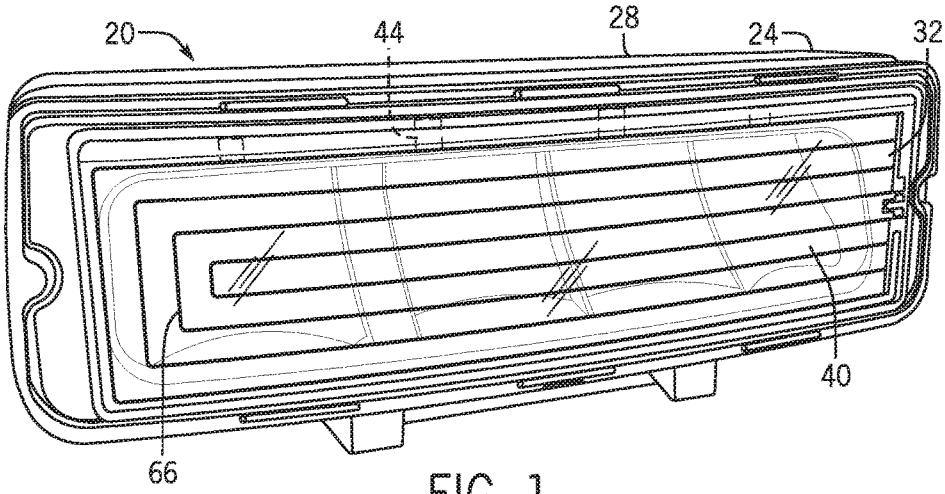
FIG. 1 is a perspective view of a lighting system with a lens heater in accordance with embodiments of the present invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION OF THE TECHNOLOGY

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the use the phraseology and terminology used herein is for the purpose of description and should not be regarded as limiting. Furthermore, the use of "right", "left", "front", "back", "upper", "lower", "above", "below", "top", or "bottom" and variations thereof herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
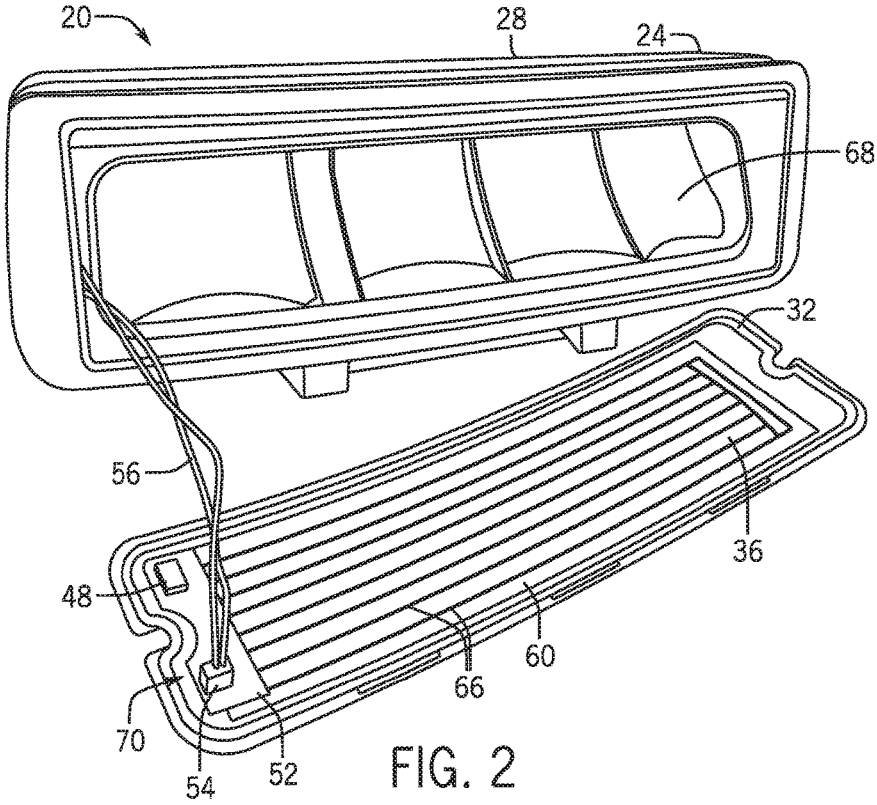
FIG. 2 is a perspective view of the lighting system of claim 1, with the lens removed.

A high optical transmission lens heater is needed to prevent icing of certain LED lighting systems. Referring to FIGS. 1 and 2, in some embodiments, an over molded screen printed conductive circuit can be used as the heating element for a lighting system 20. The lighting system 20 can include a housing 24, with the housing including a base 28 and a lens 32. The lens 32 has an interior lens side 36 and an exterior lens side 40. At least one LED 44 can be positioned within the base 28 to provide illumination through the lens 32. A lens heater assembly 70 can include a lens heater controller 48, with a lens heater circuit 52 operatively coupled to the lens heater controller 48. In some embodiments, a substantially clear thermoplastic substrate 60 can be positioned on the interior lens side 36 of the lens, and a conductive ink or film circuit 66 can be positioned on the thermoplastic substrate 60 and can be operatively coupled to the lens heater circuit 52. In some embodiments, a reflector 68 can be included to guide illumination from the one or more LEDs 44.

In some embodiments, the heating output of the heating element can be regulated based upon the temperature of the heating element traces utilizing a positive temperature coefficient (PTC) ink trace.

Figure 3:
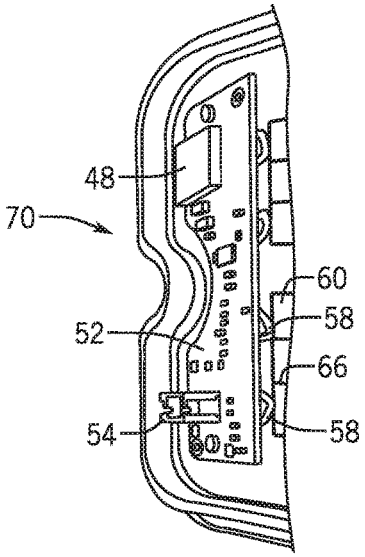
FIG. 3 is a perspective view of a portion of a lens heater assembly in accordance with embodiments of the present invention.

FIG. 3 shows an embodiment of the lens heater circuit 52. The lens heater circuit 52 can be coupled to the lens 32, or can be positioned within the base 28. When the lens heater circuit is coupled to the lens 32, as shown in FIG. 3, power wires 56 (see FIG. 2) can extend from the base and couple to a connector 54 on the lens heater circuit. In some embodiments, a conductive element 58 can be used to provide power from the lens heater circuit 52 to the conductive ink circuit 66. The conductive element can be a spring or a wire, for example.

Figure 4:
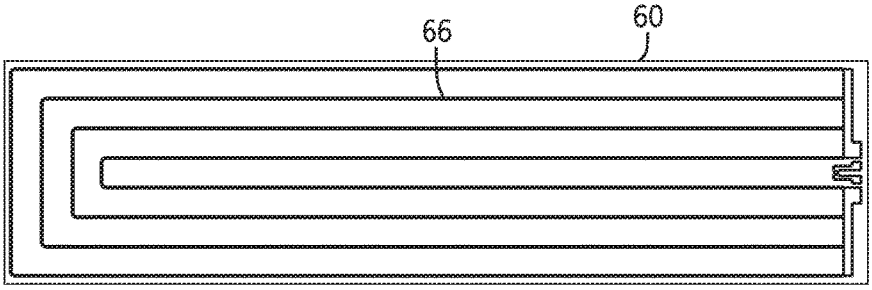
FIG. 4 is a schematic of a conductive ink or film circuit that can be used as a heating element in accordance with embodiments of the present invention.
Figure 5:
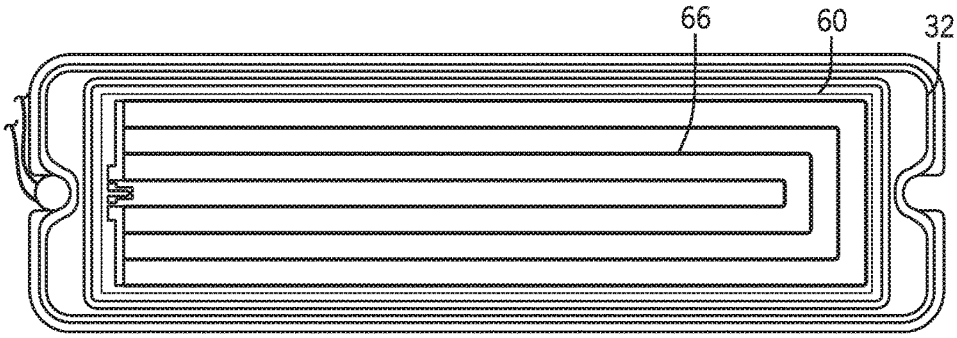
FIG. 5 is a schematic of the conductive ink or film of FIG. 4, and attached to a lens of a light.

FIGS. 4 and 5 show embodiments of a conductive ink or film circuit 66 that can be used as the heating element. It is to be appreciated that the terms ink and film are used interchangeably herein. In some embodiments, the conductive film 66 is a conductive silver trace. It is to be appreciated that other resistive elements can be used for the conductive film. FIG. 4 shows the conductive silver traces that have been screen printed on the clear substrate films 60. In some embodiments the substrate 60 can be a thermoplastic polymer. In some embodiments, the substrate 60 can be a polycarbonate substrate. Again, other substrate materials can be used. FIG. 5 shows the conductive film 66 on the substrate 60 preliminarily attached to the lighting system lens 32 for testing. The substrate 60 could be any clear or substantially clear substrate film. Opaque substrate can also be used.

An embodiment of the lens heater assembly 70 was tested using multiple types of inks with and without a dielectric top coating. The lens heater assembly 70 was also tested on multiple substrate thicknesses. FIG. 6 shows resistance repeatability data for the various configurations. In some embodiments, the lens heater circuit 52 can have a resistance in the range of about 5 ohms to about 300 ohms, depending upon the application. Some 12-24V lighting system applications may be around 30 ohms, or more or less. Other voltages and resistances are contemplated.

Figure 7:
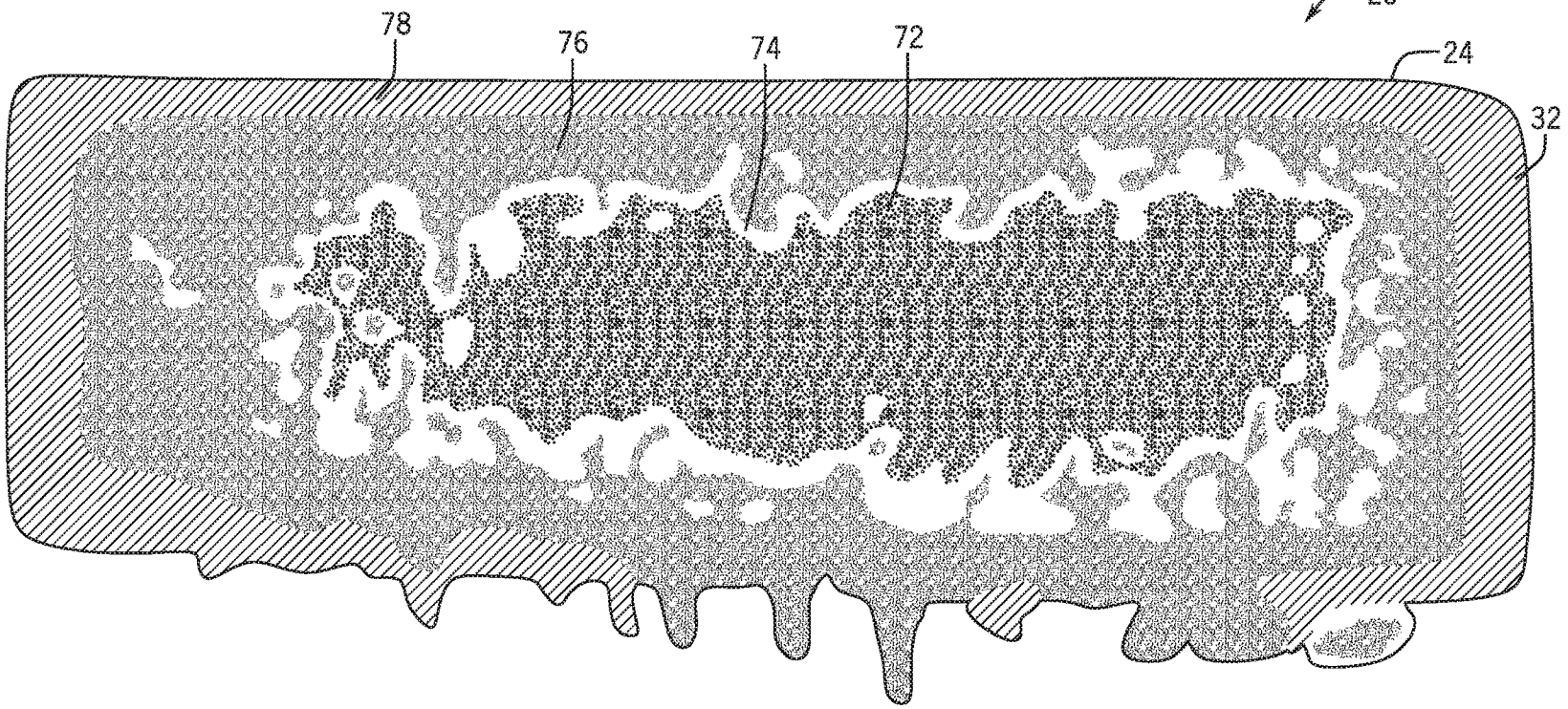
FIG. 7 is a view showing a thermal image of a lighting system with the lens heater assembly energized, in accordance with embodiments of the present invention.
Figure 8:
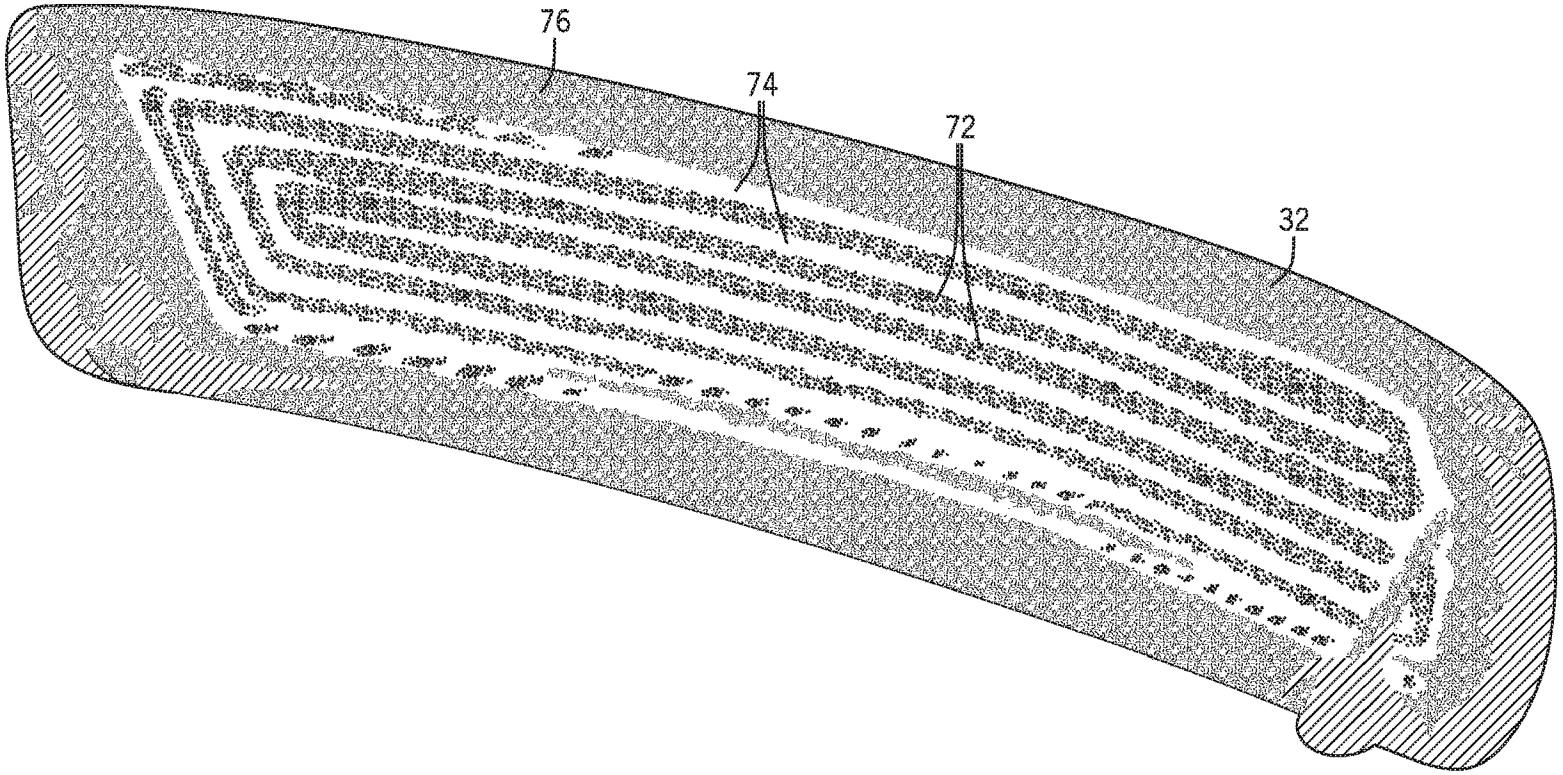
FIG. 8 is a view showing a thermal image of just the lens of a lighting system with the lens heater assembly energized, in accordance with embodiments of the present invention.

A version of the lens heater assembly 70 was taped to an existing molded outer lens 32 and thermal testing was completed on the stand alone lens 32 as well as the lamp assembly. FIGS. 7 and 8 show thermal images of the lighting system assembly 20 (FIG. 7) and just the lens 32 (FIG. 8) and with the lens heater assembly energized. In the figures, temperature is represented by 72 being hot, 74 being warm, 76 being cool, and 78 being cold. It is to be appreciated that these descriptions of hot, warm, cool, and cold are relative terms, and are only intended to show a gradient of temperature ranges that can be produced by the lighting system 20.

Figure 9:
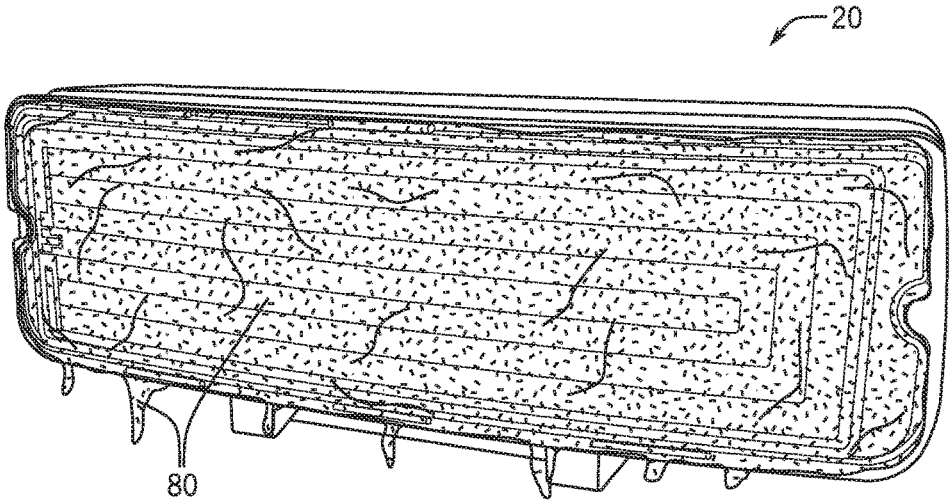
FIG. 9 is a perspective view of a lighting system with approximately 2 mm of ice buildup.
Figure 10:
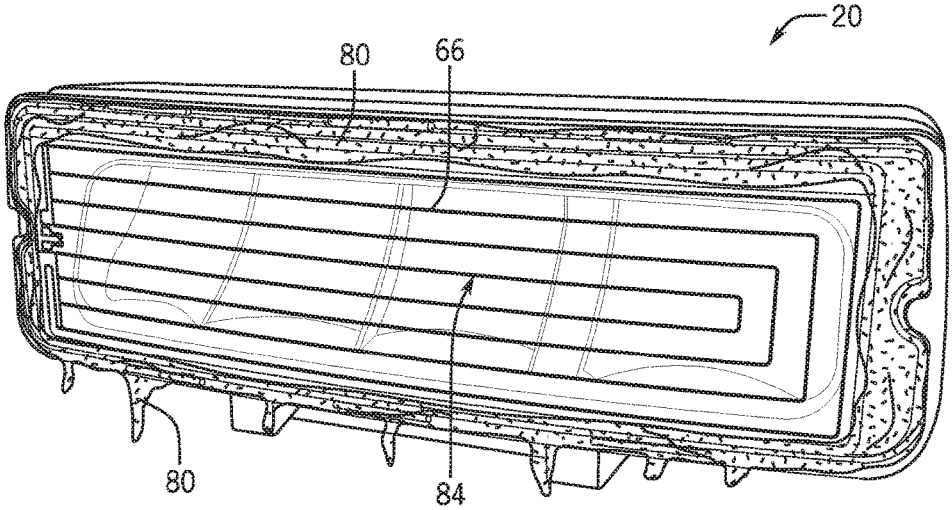
FIG. 10 is a perspective view of the lighting system of FIG. 9 with the lens heater circuit energized and with the ice substantially clear from the optical area.

FIG. 9 shows a lighting system 20 in a cooling chamber saturated at −20C. with approximately 2 mm of ice buildup 80. FIG. 10 then shows the same lighting system 20 with LEDs 44 energized, e.g., low beam and hi beam, along with the lens heater circuit 52 energized and dissipating approximately 18 watts. Ice 80 was substantially cleared from the optical area 84 in several minutes. The cooling chamber remained at −20C. with considerable convective airflow.

Figure 11:
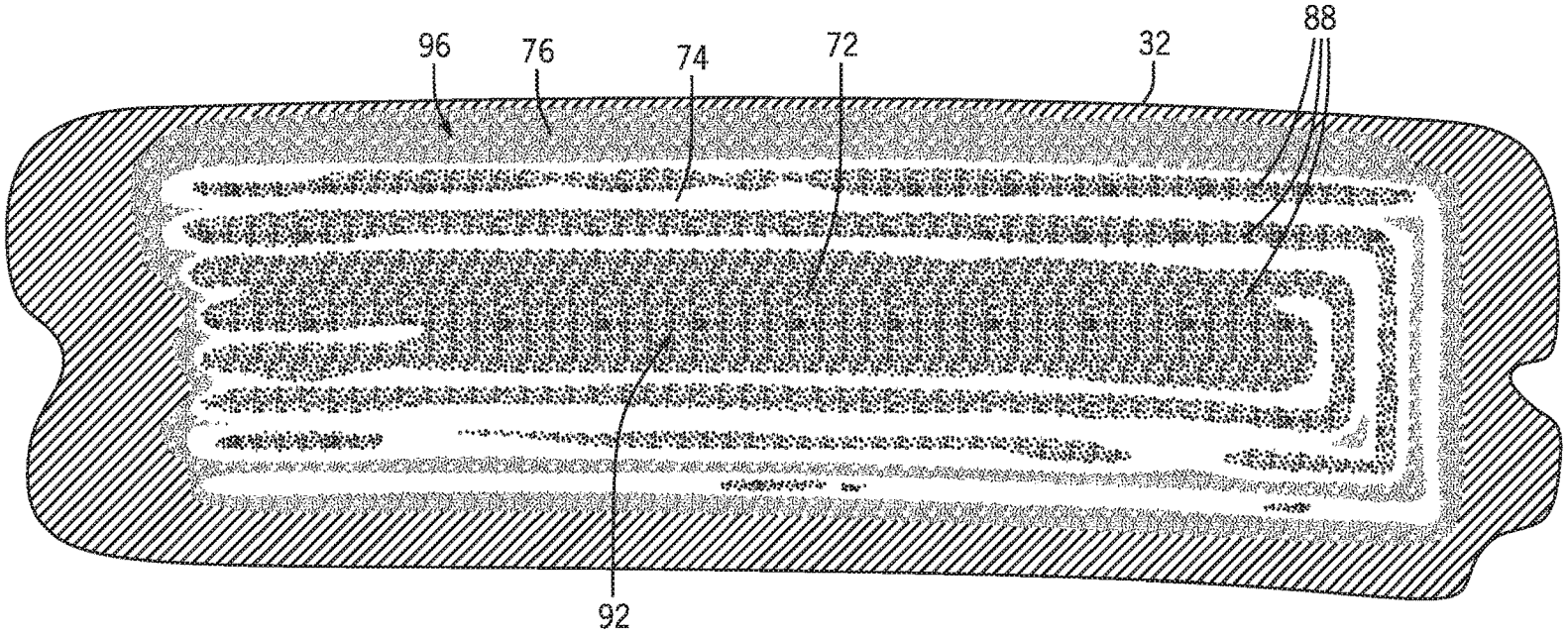
FIG. 11 is a view showing an alternative embodiment having a lens heater circuit made up of traces with generally unequal trace lengths.
Figure 12:
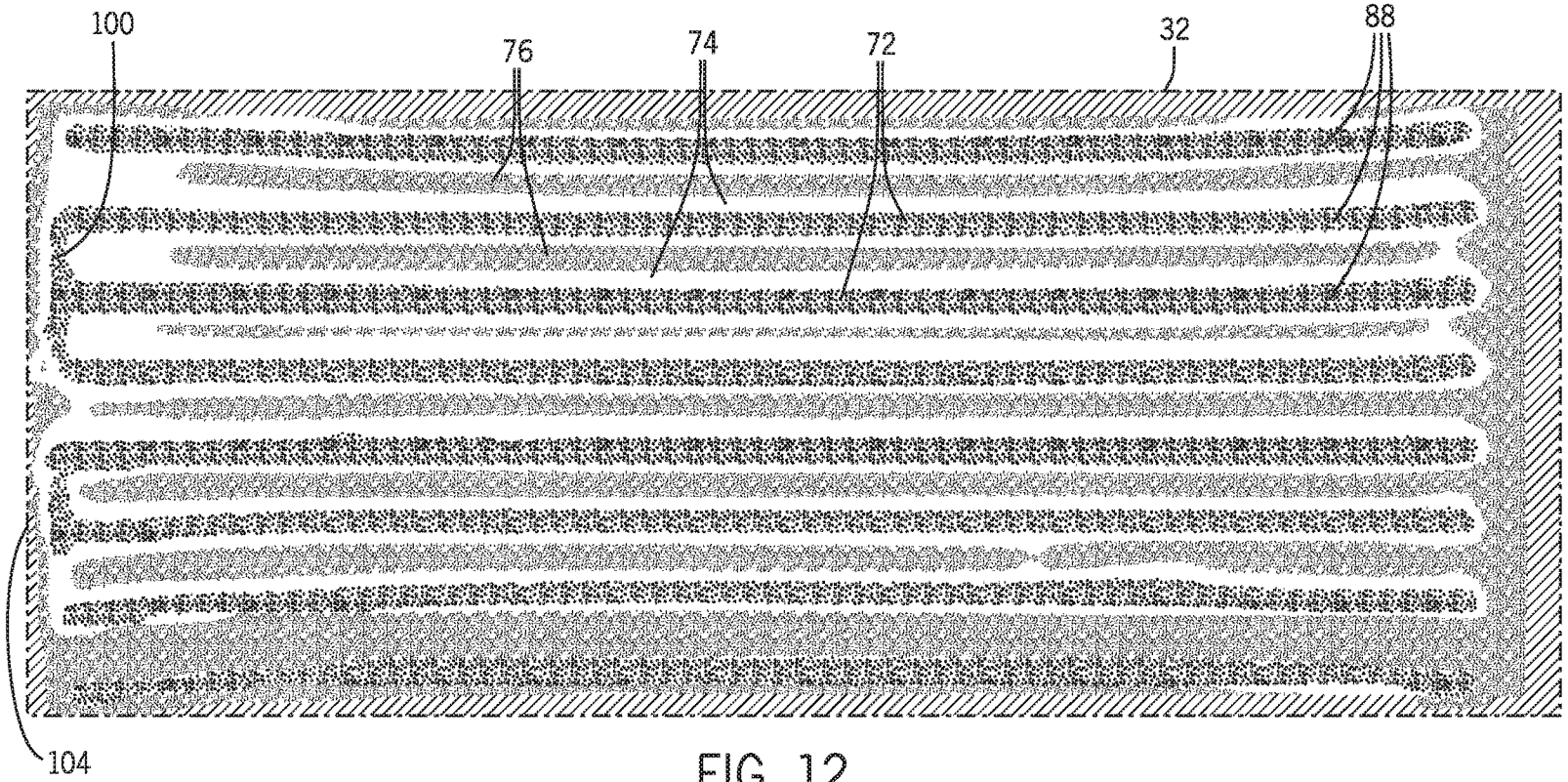
FIG. 12 is a view showing an alternative embodiment having a lens heater circuit made up of traces with generally equal trace lengths.

FIG. 11 shows one embodiment having a lens heater circuit 52 made up of traces 88 with unequal trace lengths. This arrangement created non-uniform heating of the traces 88. This arrangement may be useful for certain applications. Slightly warmer heating in the center 92 can be seen as compared to the edges 96. FIG. 12 shows an additional embodiment with generally equal length traces 88. A more uniform heating can be seen. The traces can be connected with a busbar 100 on the non-power connect end 104 to allow for equal trace lengths, which can also be useful in certain applications. In the figures, temperature is represented by 72 being hot, 74 being warm, 76 being cool, and 78 being cold. It is to be appreciated that these descriptions of hot, warm, cool, and cold are relative terms, and are only intended to show a gradient of temperature ranges that can be produced by the lighting system 20.

In some embodiments, a silver based screen printable ink can be used as the lens heater traces 88. Silver allows for low resistance traces even when the traces are very thin. In some embodiments, the ink can be printed at a thickness between about 5-15 micrometers (could vary more or less than this in other embodiments). Other conductive inks could be utilized provided they can meet the overall resistance requirements for various applications.

In some embodiments, the width of the lens heater traces used as heating elements can be about 0.35 mm. This can vary from about 0.05 mm to about 1.0 mm on various embodiments. The lens heater traces can be spaced at approximately 8 mm to provide uniform heating of the entire lens surface. This distance can be increased to approximately 15 mm and still be effective, and can be reduced for other applications. It is to be appreciated that other dimensions are possible.

In some embodiments, the overall resistance of the lens heater circuit 52 can be about 30 ohms. In other embodiments, this can vary from about 5 ohms to about 300 ohms in various designs.

Through testing, it has been found that approximately 1 W/in^2 applied to the internal surface of a thermoplastic polymer outer lens 32 can be an adequate amount of power per optical area of an LED lamp to effectively de-ice. In other embodiments, this could be increased to 2 W/in^2 or more on other designs. Some embodiments of the lighting system 20 can be designed around a dissipation of about 18 Watts. It is to be appreciated that other dissipations are possible.

In other embodiments, the lens heater portion may not necessarily need to be opaque traces of a conductive ink. The lens heater traces 88 could be a substantially transparent ink, for example, (e.g., approximately 85 percent, or more or less, transmission), that can cover a portion or the entire surface of the heater substrate 60. This transparent ink may also include a more conductive ink screen over it to create busbars and input power connection points. Non-limiting examples of clear conductive ink include those based on carbon or graphite nanotechnology, silver micro or nano structures, as well as indium tin oxide, silver or copper micro foil grids.

Figure 13:
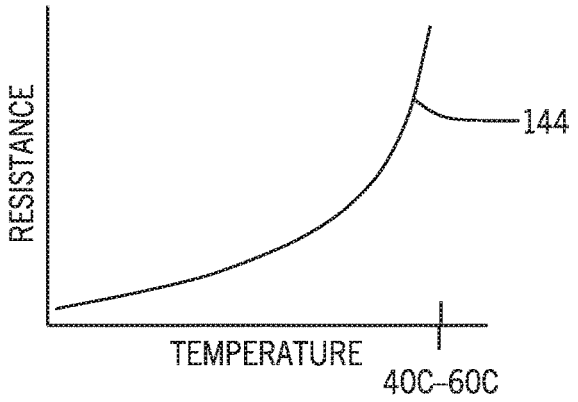
FIG. 13 is a graph showing a key characteristic of PTC inks.

As mentioned above, PTC ink traces 108 may also be incorporated into the lens heater circuit 52. FIG. 13 is a graph that shows a key characteristic of PTC inks. As the temperature increases so does the resistance of the PTC ink. At a certain predetermined temperature, the increase in resistance can become exponential. In some embodiments, a PTC trace 108 can be located near one or more of the lens heater traces 88. In some embodiments, when the lens heater trace 88 approaches about 40C.-60C., the PTC trace resistance can go to infinity. A lens heater controller 48 can recognize this change in resistance and vary voltage supplied to the lens heater circuit 52 to keep the lens heater trace 88 at or near about 40C. during operation. In some embodiments, a 40C. PTC ink offered by Henkel AG & Company, KGaA, can be used. PTC inks from Dupont and others can also be used.

Figure 14:
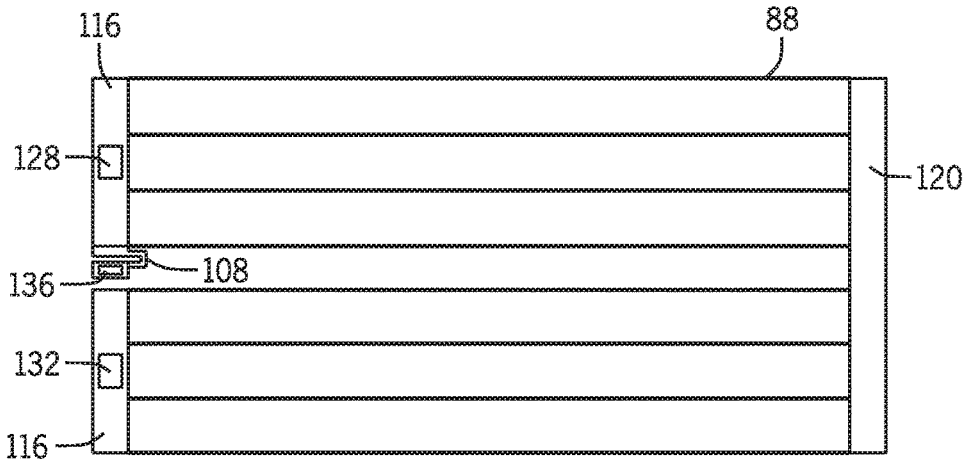
FIG. 14 is a schematic view showing an embodiment of a lens heater assembly layout (without the lens heater circuit) and with the PTC trace for temperature sensing.

FIG. 14 shows an embodiment of a lens heater assembly 70 layout (without the lens heater circuit 52) and with the PTC trace 108 for temperature sensing. With the opposing busbar 120, in some embodiments, most or all traces can be substantially equal length and can heat uniformly. There can be multiple connection points (could have more than one connection per power busbar 116 to reduce current traveling through a single point). The top connection point 128 and bottom connection point 132 support the potential across the lens heater traces 88. The top 128 and center 136 connection points allow for measurement of resistance across the PTC trace 108 serving as a thermistor.

Figure 15:
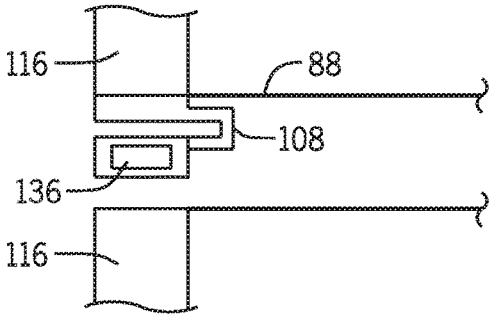
FIG. 15 is an enlarged view of a portion of FIG. 14 showing the PTC trace.

FIG. 15 shows the PTC trace 108 enlarged. Since the PTC trace can run along side the lens heater trace 88, it can nearly have the same temperature as the lens heater trace. As the lens heater trace approaches 40C., the PTC trace's resistance can begin to increase exponentially. At some point on the exponential curve 144 (see FIG. 13), the lens heater controller 48 can begin to regulate the lens heater voltage and thus decrease the power being dissipated by the lens heater circuit 52.

Figure 16:
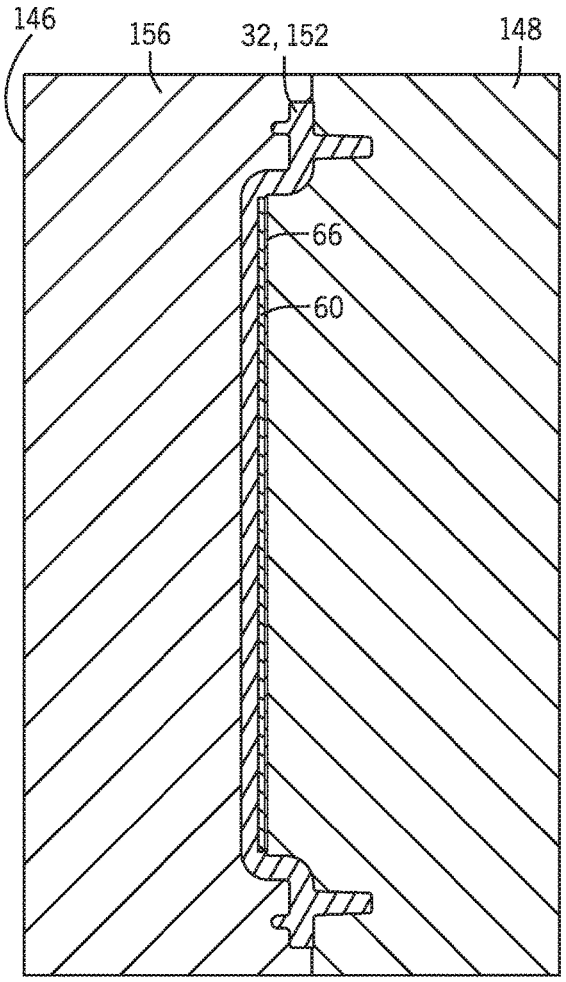
FIG. 16 is a schematic view showing a positioning of the ink and screen printed substrate in an injection molding tool to produce a lighting system lens with a lens heater in accordance with embodiments of the present invention.
Figure 17:
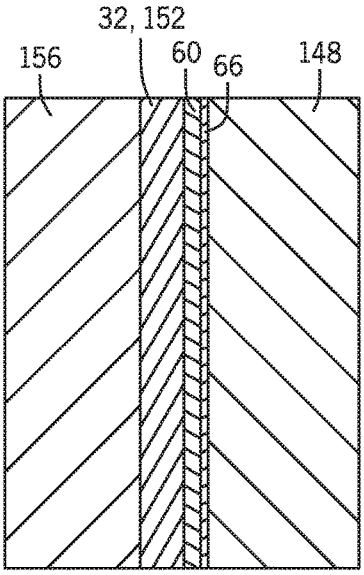
FIG. 17 is an enlarged view of a portion of FIG. 16.

FIG. 16 shows the positioning of the ink 66 and screen printed substrate 60 in an injection molding tool 146 to produce a lighting system lens with a lens heater. FIG. 17 is a close-up view. The clear substrate 60 with a screen printed conductive ink 66 pattern can be placed into a pocket on the core 148 with the ink side against the core. In this arrangement, the exposed ink side can remain exposed on the final lighting system lens part 32. Molten resin can then over mold the substrate 60, bonding only to the non-printed side of the clear substrate 60. In some embodiments, various types of thermoplastic polymers, such as polycarbonate materials, can be utilized as the injected resin 152 for the lens 32. It is to be appreciated that other assembly arrangements are contemplated where the ink 66 side remains exposed on the final lighting system lens part 32.

Figure 18:
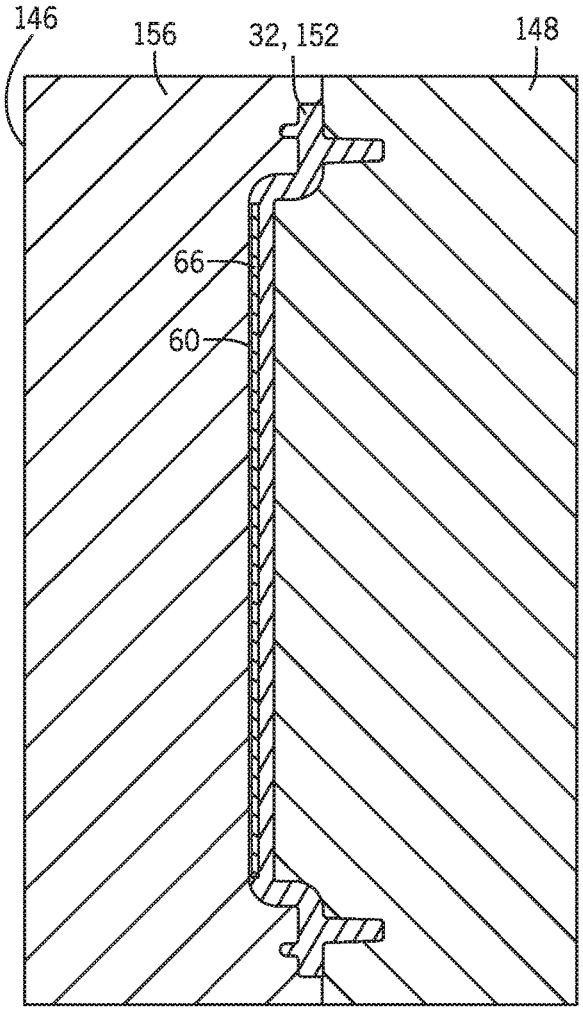
FIG. 18 is a schematic view showing an alternative positioning of the ink and screen printed substrate in an injection molding tool to produce a lighting system lens with a lens heater in accordance with embodiments of the present invention.
Figure 19:
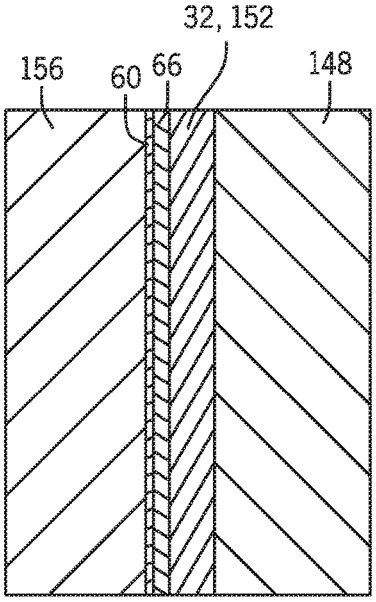
FIG. 19 is an enlarged view of a portion of FIG. 18.

FIG. 18 shows an alternative arrangement for the positioning of the ink 66 and screen printed substrate 60 in an injection molding tool 146 to produce a lighting system lens with a lens heater. FIG. 19 is a close-up view. The ink 66 can be encapsulated as well as with the clear substrate 60 placed against the cavity side 156 of the tool.

Testing showed successful over molding of the thermoplastic film substrate screen printed lens heater traces 88. Both were taped to the core of the injection molding tool to prevent material from pushing the label up against the cavity 156. The tool 146 can be modified to recess the thermoplastic substrate 60 and conductive ink 66 into the core 148 and to hold it there with a vacuum. In some embodiments, the conductive ink 66 can be exposed on the interior side 36 of the lens 32.

FIG. 20 includes a table that shows the optical impact of the lens heater traces 88 on low beam illumination and hi beam illumination. The impact of the lens heater traces 88 on illumination output is only minimal, and may be non-perceivable, and can be reduced further through thinner lens heater traces. In some embodiments, greater than 90 percent transmission rate in terms of both lumens and intensity can be achieved. This can be varied depending on the lighting system application by varying a thickness of the lens heater traces and the material used for the conductive traces 66 and the substrate 60.

Figure 21:
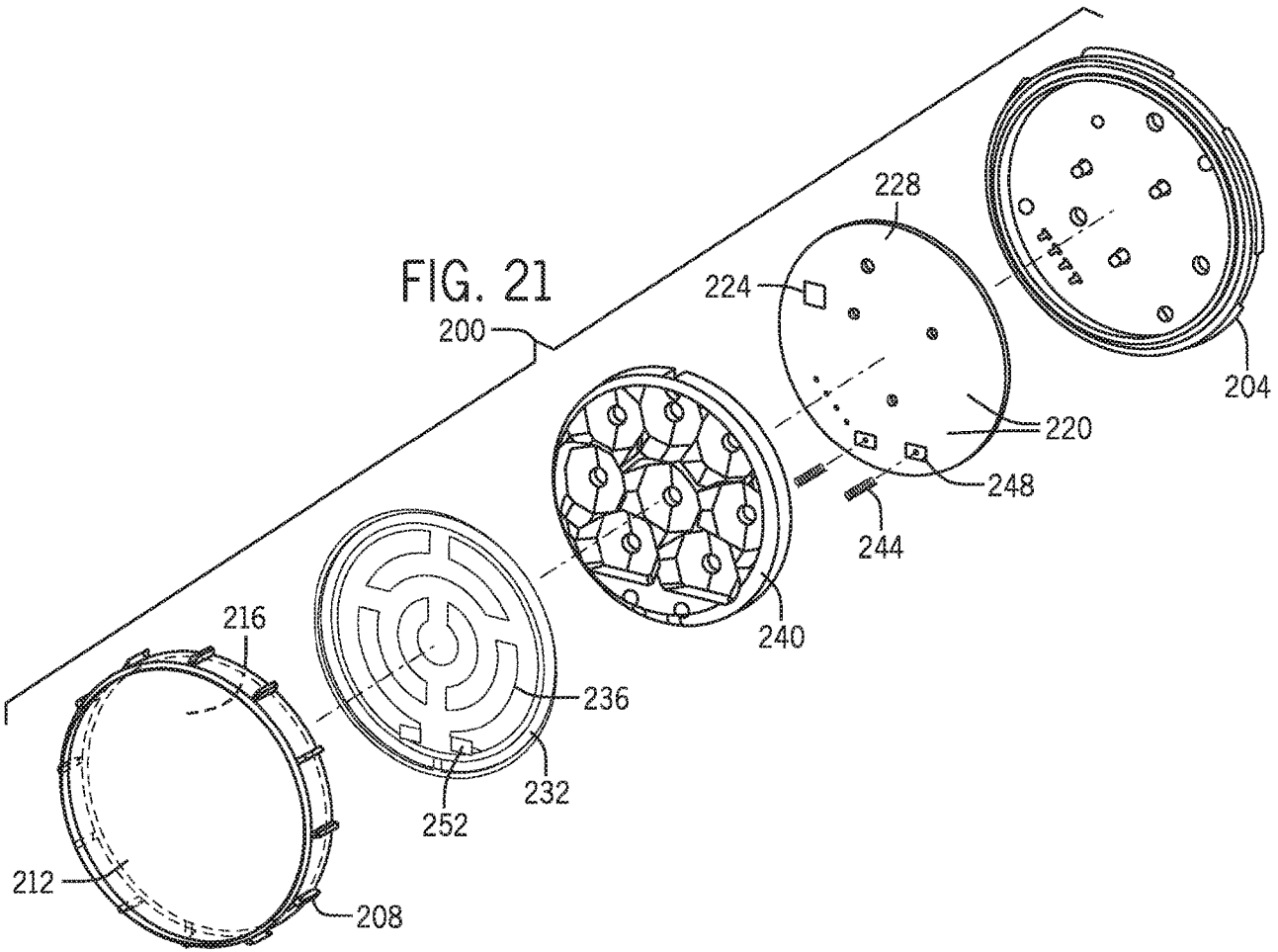
FIG. 21 is an exploded perspective view of an alternative embodiment of a lighting system with a lens heater in accordance with embodiments of the present invention.

FIG. 21 shows an alternative embodiment of a lighting system 200. The lighting system 200 can include a base 204 and a lens 208. The lens 208 has an interior lens side 216 and an exterior lens side 212. At least one LED 220 can be positioned within the base 204 to provide illumination through the lens 208. A lens heater assembly 222 can include a lens heater controller 224, with a lens heater circuit 228 operatively coupled to the lens heater controller 224. In some embodiments, a substantially clear thermoplastic substrate 232 can be positioned on the interior lens side 216 of the lens, and a conductive ink or film circuit 236 can be positioned on the thermoplastic substrate 232 and can be operatively coupled to the lens heater circuit 228. In some embodiments, a reflector 240 can be included to guide illumination from the one or more LEDs 220. In some embodiments, the lens heater circuit 228 can include one or more contacts 248 to allow for the transmission of power from the lens heater circuit 228 to the conductive ink circuit 236. A conductive element 244, e.g., a spring or a wire, can be positioned to electrically couple the contact 248 with a contact 252 on the conductive ink circuit 236. In some embodiments, the conductive element 244 can pass through the reflector 240 to provide the power from the lens heater circuit 228 to the conductive ink circuit 236.

The present disclosure describes embodiments with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the embodiments may be combined in any suitable manner in one or more embodiments. In the description, numerous specific details are recited to provide a thorough understanding of embodiments of the invention. One skilled in the relevant art will recognize, however, that the embodiments may be practiced without one or more of the specific details, or with other methods, components, materials, and so forth. In other instances, well-known structures, materials, or operations are not shown or described in detail to avoid obscuring aspects of the invention. Accordingly, the scope of the technology should be determined from the following claims and not be limited by the above disclosure.

The invention claimed is:

1. A heating system for heating the lens of a lighting system, the heating system comprising:

a substantially clear thermoplastic substrate;

a conductive ink or film circuit including traces that are generally equal in length, positioned on the thermoplastic substrate to heat the thermoplastic substrate;

a lens heater circuit, with a lens heater controller operatively coupled to the lens heater circuit;

a busbar disposed on a non-power connect side of the heating system and configured to connect the traces; and wherein a heating output of the conductive ink or film circuit is regulated based upon a sensed temperature of the conductive ink or film circuit.

2. The heating system according to claim 1, wherein the conductive ink or film circuit is screen printed on the thermoplastic substrate.

3. The heating system according to claim 1, wherein the conductive ink or film circuit is a conductive silver trace.

4. The heating system according to claim 1, wherein a heating output of the conductive ink or film circuit is regulated based upon the sensed temperature of the conductive ink circuit utilizing a positive temperature coefficient (PTC) ink trace.

5. The heating system according to claim 1, further including a dielectric top coating on the conductive ink or film circuit.

6. The heating system according to claim 1, wherein the conductive ink or film circuit has a resistance in a range of about 5 ohms to about 300 ohms.

7. The heating system according to claim 1, wherein the traces have a width in a range of about 0.05 mm to about 1.0 mm.

8. The heating system according to claim 1, wherein the conductive ink or film circuit produces about 1 W/in^2.

9. The heating system according to claim 1, wherein the conductive ink or film circuit is a substantially transparent ink.

10. The heating system according to claim 1, wherein the lens heater controller regulates the conductive ink or film circuit voltage to increase or decrease a power being dissipated by the conductive ink or film circuit.

11. The heating system according to claim 1, further including a lighting system lens, wherein the conductive ink or film circuit remains exposed on an inside of the lighting system lens.

12. An LED lighting system having a heated lens, the LED lighting system comprising:

a housing, the housing including a base coupled to a lens, the lens having an interior lens side and an exterior lens side;

at least one LED positioned within the base and spaced apart from the lens, the at least one LED positioned within the base to provide illumination through the lens;

a lens heater controller;

a lens heater circuit operatively coupled to the lens heater controller;

a substantially clear thermoplastic substrate positioned on at least one of the interior lens side and the exterior lens side;

a conductive ink or film circuit, including traces that are generally equal in length, on the thermoplastic substrate to heat the thermoplastic substrate, the conductive ink or film operatively coupled to the lens heater circuit; and a busbar positioned on a non-power connect side within the housing, the traces connected to the busbar.

13. The LED lighting system according to claim 12, wherein greater than 90 percent transmission rate in terms of both lumens and intensity is achieved.

14. A method for heating a lens of a lighting system, the method comprising:

applying a conductive ink or film circuit, including traces that are generally equal in length, on a substantially clear thermoplastic substrate;

applying the conductive ink or film circuit on the substantially clear thermoplastic substrate to at least one of an interior lens side and an exterior lens side;

connecting the traces via a busbar on a non-power connect portion of the lighting system; and applying a controlled power to the conductive ink or film circuit to heat the lens.

15. The method according to claim 14, further including:

applying a PTC trace substantially near the conductive ink or film circuit;

sensing a resistance of the PTC trace; and controlling the power to the conductive ink or film circuit based on the sensed resistance of the PTC trace.

16. The method according to claim 14, further including placing the conductive ink or film circuit on the substantially clear thermoplastic substrate into a pocket on a core of an injection molding tool, with a conductive ink or film circuit side against the core, such that the conductive ink or film circuit side remains exposed on a final lighting system lens part.

17. The method according to claim 16, further including:

over molding the thermoplastic substrate with a thermoplastic resin; and bonding the thermoplastic resin only to a non-conductive side of the thermoplastic substrate.

18. The method according to claim 16, further including recessing and holding the thermoplastic substrate in the core with the injection molding tool, wherein the injection molding tool uses a vacuum.

19. The method according to claim 14, further including placing the conductive ink or film circuit on the substantially clear thermoplastic substrate against a cavity side of an injection molding tool, with a conductive ink or film circuit side encapsulated between the thermoplastic substrate and a final lighting system lens part.

* * * * *